United States Patent [19]

Heidborn

[11] 4,341,603

[45] Jul. 27, 1982

[54] PROCESS FOR MANUFACTURING SCREENS FOR CENTRIFUGALS, PARTICULARLY WORKING SCREENS FOR CONTINUOUSLY OPERATING SUGAR CENTRIFUGALS

[75] Inventor: Ernst Heidborn, Brunswick, Fed. Rep. of Germany

[73] Assignee: Balco Filtertechnik GmbH, Brunswick, Fed. Rep. of Germany

[21] Appl. No.: 51,634

[22] Filed: Jun. 25, 1979

[30] Foreign Application Priority Data

Jul. 5, 1978 [DE] Fed. Rep. of Germany ..... 2829529

[51] Int. Cl.[3] ..... C25D 1/08

[52] U.S. Cl. ..... 204/11; 204/24

[58] Field of Search ..... 204/11, 24

[56] References Cited

U.S. PATENT DOCUMENTS

| | | | |
|---|---|---|---|
| 2,225,734 | 12/1940 | Beebe | 204/11 |
| 2,226,381 | 12/1940 | Norris | 204/11 |
| 2,226,383 | 12/1940 | Norris | 204/11 |
| 2,469,689 | 5/1949 | Gresham | 204/11 |
| 2,762,149 | 9/1956 | Mears | 204/11 |
| 3,192,136 | 6/1965 | Reid | 204/11 |

*Primary Examiner*—T. Tufariello

*Attorney, Agent, or Firm*—W. G. Fasse; D. F. Gould

[57] ABSTRACT

Working screens for centrifugals, especially sugar centrifugals are made by electrodeposition of screen material on an electrically conducting matrix without filling the screen slots. Support material is then deposited on the screen material even to the extent that the screen slots are filled by the support material which is not resistant to an etchant whereas the screen material is resistant to such etchant. Thereafter the screen slots are opened by an etching step. In a modification three separate deposition steps are performed to form screen slots which open rearwardly so that the slot surface is larger on the rear of the screen than on the front of the screen.

9 Claims, 2 Drawing Figures

Figure 1:
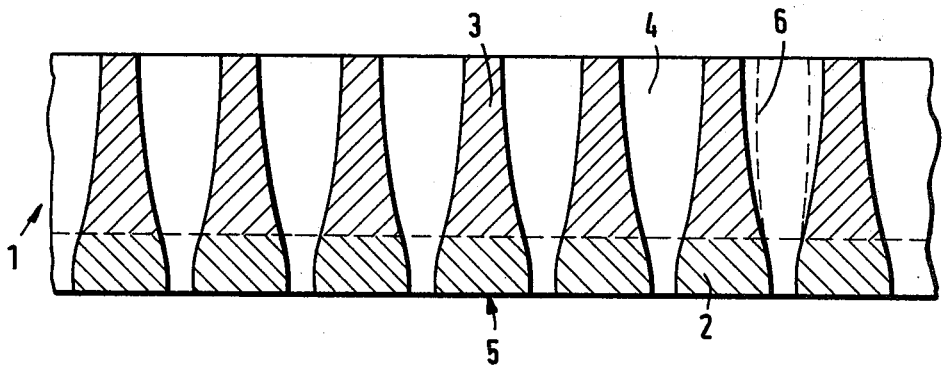

PROCESS FOR MANUFACTURING SCREENS FOR CENTRIFUGALS, PARTICULARLY WORKING SCREENS FOR CONTINUOUSLY OPERATING SUGAR CENTRIFUGALS

BACKGROUND OF THE INVENTION

Where continuously operating sugar centrifugals are concerned, it often matters, subject to their use, to separate from the massecuite even crystals having a relatively small grain size as, for example, in the processing of low-grade massecuites, because fine crystals not retained by the working screen would pass, together with the run-off into the final molasses, thus reducing the sugar yield. However, even in the processing of middle-grade massecuites, the object is to have the smallest possible quantity of sugar crystals pass into the run-of syrup.

Experiences have shown that with regard to the retention of the fine crystals the working screens of continuously operating sugar centrifugals should have slotted holes of about 0.04 to 0.06 mm width. The sides of the slotted holes should be as smooth as possible and these sides must widen the slot in the direction of the liquid passage in order to avoid clogging and rear incrustation.

Another criterion for the utility of the working screens is their relative open screening area which affects the throughput of the respective continuously operating centrifugal. The amount of liquid which can be separated by a screen per unit of time, with all other circumstances being the same, is the larger, the larger the sum of the screen hole cross-sections is per unit of screening area. Hence, the open screening area has a throughput-limiting influence on the centrifugal. With the processes hitherto used for the manufacture of working screens for continuously operating centrifuges it is possible, however, to produce screens only having an open screening area of about 6.5% at best, if at the same time a screen thickness shall be ensured which is satisfactory at least to some extent as far as the useful operating life of such screens is concerned.

By punching, a process which is used only in exceptional cases for the manufacture of working screens for continuously operating sugar centrifugals, high-grade steel screens having a maximum thickness of 0.18 mm and an open screening area of only 5.5% may be manufactured. Moreover, special auxiliary steps must be taken in this process to produce conical screen holes. The attainable open screening area of these screens is as unsatisfactory as the relatively small screen thickness. Besides, punching results in rough cutting surfaces and burrs, which increases the risk of clogging as a result of incrustation. The slotted area of these screens must be subjected to a bending and upsetting action in order that the screens may be manufactured at all by punching. Therefore, the exactness of the slot contours and dimensions is adversely affected. Both, the slot contour and the slot dimension, however, are essential factors of the separating characteristics.

As compared to the punching process, the electroforming process chiefly used hitherto for the manufacture of working screens has the advantage of ensuring very smooth surfaces and exact slot contours. Furthermore, it is possible to manufacture screens of 0.24 to 0.28 mm thickness with a slot width of about 0.06 mm. Compared to punched screens, this represents an increase in screen thickness of about 0.1 mm resulting in a corresponding increase in service life. Moreover, these electroformed screens are superiors to punched screens because with their open screening area of 6.0 to 6.5% the open screening area is larger by about 1%. These values, however, are the limits of the electroforming process as it is known hitherto. Though larger open screening areas are attainable, this is possible only when the screen thickness is reduced at the same time due to the given growth laws of electrodeposition on matrices. From an electro-conductive spot on the surface of a matrix, material is deposited in a substantially uniform manner both horizontally and vertically. However, a screen slot is bounded by two edges. Thus, the material spreads from both edges into the open screen slot during depositing. When, for example, a screen having a thickness of 0.1 mm and screen slots of 0.1 mm width shall be manufactured, the screen slot edges lying on the matrix must be spaced apart $0.1+2\times0.1=0.3$ mm. If this spacing is not maintained, the resulting screen slots will be too narrow. If, under the same prerequisites material is deposited up to a thickness of 0.15 mm, the screen slots have grown closed. Thus, the spacing between the screen slot edges on the matrix has to be the greater, the thicker the screen is to become. Therefore, the spacing between neighboring screen slots becomes the greater, the thicker the screen is and the open screening area decreases as the screen thickness increases.

In the past, electroformed working screens for continuously operating sugar centrifugals have been put on the market. However, due to these facts, although the open screening area exceeded 6.5%, at least some of these screens had a thickness substantially less than 0.2 mm. These screens had to be reinforced at the rear by supporting screens, against the stress caused by the squeezing load caused by the massecuites sliding over the working area under the high gravity field of the centrifugal.

These supporting screens do not only have the disadvantage to cause an additional expense, they also reduce the effective screening area because they cover part of the rear of the screen slots of the working screen. The increase in open screening area obtained at the price of a reduction of the screen thickness is reduced again by the need for a supporting screen due to the small screen thickness. Furthermore, the additional supporting screen arranged behind the working screen results in an aggravation of the flow conditions and increases the risk of incrustation.

In spite of the supporting screen, these "thin" working screens are more delicate and vulnerable in use so that they have to be replaced more frequently than screens of normal thickness. Any screen replacement always involves a down time of several hours. Therefore, the known "thin" screens having a larger open screening area do not represent a satisfactory solution.

OBJECTS OF THE INVENTION

It is the object of the present invention to manufacture screens by electrodepositing a metallic material on matrices, the screens having an open screening area and/or thickness which is larger/greater than hitherto possible by virtue of the inherent laws of electrodeposition.

SUMMARY OF THE INVENTION

Starting from a process for electroforming of screens, in particular, of working screens for continuously operating sugar centrifugals, according to which first an electro-conductive matrix defining the screen pattern is made, on which matrix screen material is then electrodeposited, whereafter the finished screen is removed from the matrix, characterized in that the electrodeposition of the screen material is terminated before the necessary screen thickness is reached as soon as the screen slots have reached the desired dimensions due to lateral growth, whereafter another metallic support material is deposited on the screen material until a thickness corresponding approximately to the required screen thickness is reached, while the screen slots are filling up gradually at the same time, and in that the intermediate product obtained in this way is treated, after its removal from the matrix with a liquid etchant which is aggressive on the supporting material but does not attack the screen material, until the screen slots filled up with supporting material are cleared and are open through the supporting material to the rear side of the screen.

In order to keep the lateral etching-away of the supporting material at the screen slot sides within the desired limits, the process according to the invention may be embodied in various ways. Thus, it is particularly simple to direct the etchant against the surface of the screen material.

In an embodiment which is advantageous as far as expenditure of work is concerned, the etchant is directed in jets from the bottom towards the top against the surface of the screen material.

In another embodiment of the present process the rear of the screen, i.e., the surface of the supporting material is coated prior to the etching with a preferably non-metallic insulating material with a pattern corresponding to the screen pattern and registering with the screen pattern on the front of the screen, and the etchant is then applied to both sides of the intermediate product.

To ensure the desired angles of the screen slot sides within the supporting material it is advisable that the screen pattern of the insulating material applied to the surface of the supporting material be adapted to the larger slot width on the rear of the screen or to the surface of the supporting material.

It is an advantage when the insulating material is applied by a screen printing process.

According to another independent feature of the invention, it is possible to further increase the screen thickness by applying to the surface of the supporting material a negative screen pattern made of a non-conductive insulating material, which registers with the screen pattern and which allows for the larger screen slot width on the rear of the screen, up to a thickness which together with the thickness of the already electrodeposited metallic materials at least equals, or slightly exceeds, the desired screen thickness, and by subsequently electrodepositing on the areas of the supporting material which have remained metallically bright, another metallic covering material which is not attacked by the etchant, until the desired screen thickness is reached whereby the lateral gradual filling-up of the screen slots is avoided by the insulating material applied in the screen slot areas according to the negative screen pattern, and by subsequently removing the insulating material and applying an etchant to both sides of the intermediate product obtained in this manner until the screen slots are opened.

It is expedient that after etching the screen is electroplated with a surface refining material.

In a preferred embodiment of the invented process nickel is deposited as a screen and covering material and copper as a supporting material, whereas a 30% sodium chloride solution is used as an etchant and a photosensitive resist such as a so-called photo lacquer, a resist lacquer as used in screen printing, or an epoxy resin is applied as an insulating material.

The particular advantage of the invention is seen in that the compromise between screen thickness and open screening area, which had hitherto been inevitable, is not necessary any longer. According to the invention, it is possible to construct the screen pattern matrix in accordance with a screen pattern in which, for example, a 16% open screening area and an 0.06 mm slot width remain, if a screen material such as pure nickel, is deposited in a layer up to a thickness of 0.12 mm. If subsequently 0.33 mm supporting material, for example copper, is deposited, a screen results which has a total thickness of 0.45 mm.

If prior to the etching a negative of the screen pattern made of insulating material, is applied to the copper surface up to a thickness of approximately 0.06 mm and then a covering material, such as pure nickel is deposited in a layer having a thickness of up to 0.06 mm, the screen resulting after each etching has a total thickness of 0.51 mm and an open screening area of 16% while the slot width is 0.06 mm.

A comparison with screens manufactured by the prior art process gives the following results.

Screens with an open screening area of 15 to 16% could hitherto be manufactured only to a maximum thickness of 0.12 mm. Screens manufactured by the process of the invention may be four times as thick, with the opening screening area being the same. The working screens hitherto used in continuously operating centrifugals have a maximum thickness of 0.24 to 0.28 mm with an open screening area of 6 to 6.5%. Contrary thereto, screens manufactured according to the invention may have twice this open screening area and at the same time the present screens may also be twice as thick, namely, 0.51 mm. The stated numerical values do not at all represent limits for the present process. Likewise, the disclosed materials and intermediate thicknesses may be varied to a great extent within the scope of the invention.

In actual practice the implementation of the present process means that it is now possible to multiply the hitherto imaginable values for the maximum open screening area within a wide range without having to put up with a simultaneous reduction of the screen thickness as was necessary heretofore. Alternately, screens may be made according to the invention with an open screening area within the range of prior art screens but several times thicker than the prior art screens whereby the present screens may be made more rigid from a strength point of view.

In this connection, great possibilities are offered by the selection of the material combination, for it is possible to combine hardness of the surfaces with toughness so that substantial adaptations to given load conditions are possible.

BRIEF FIGURE DESCRIPTION

Figure 2:
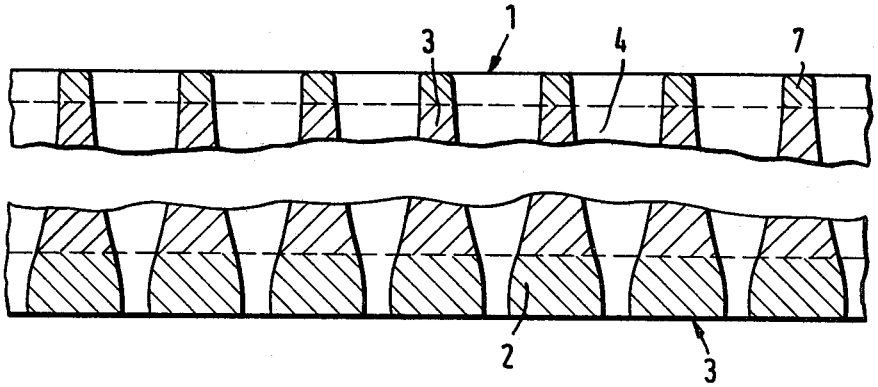

The invention will now be described by way of an example embodiment with reference to the accompanying drawings, wherein:

FIG. 1 is a sectional view of an embodiment of a screen produced according to the invention; and FIG. 2 is a sectional view of another embodiment of a screen produced according to a further advanced process.

DETAILED DESCRIPTION OF PREFERRED EXAMPLE EMBODIMENTS AND OF THE BEST MODE OF THE INVENTION

In an example embodiment of the process according to the invention for the manufacture of screens, in particular of working screens for continuously operating sugar centrifugals, first a matrix is made in a conventional manner. The surface of this matrix exhibits a screen pattern composed of electrically conducting and non-conducting portions adapted to the screen pattern of the working screen to be manufactured. The electrically non-conducting portions define the screen holes or screen slots, of the screen to be manufactured. In accordance with the expected lateral growth of the electrodeposits, the non-conductive portions are proportionately wider than the screen slots of the screens to be manufactured. The distances between the non-conductive portions are selected in such a manner that on the basis of the desired width of the screen slots of, for example, 0.06 mm an open screening area of the finished screen of 16% is obtained at a corresponding, given slot length and at a given distance between the rows of slots. Then, initially pure nickel as screen material is deposited galvanically on the prepared matrix to a thickness of 0.12 mm, whereby the screen slot edges extend toward one another directly on the matrix surface over the non-conductive portions of the matrix and approach each other to 0.06 mm. However, the spacing between the side flanks of the screen slots is the larger, the greater the distance is from the matrix surface. Thus, the conical enlargement of the screen slots ensues by itself. Onto the deposited pure nickel layer of 0.12 mm thickness copper is then electrodeposited as a supporting material until the total thickness of the deposited material equals the thickness of the screen to be manufactured. In the described example embodiment, 0.33 mm copper is deposited so that a screen having a thickness of 0.45 mm results. Electrodeposition of copper also results in lateral growth. Consequently, the screen slots are grown closed after the deposition of the supporting material. Now the intermediate product obtained is removed from the matrix. In order to expose the screen slots again, etching is carried out with a 30% sodium chloride solution. This etchant does not attack upon pure nickel, whereas it is aggressive on copper.

In order to etch the screen slots sides in the area of the supporting material to the smallest extent possible, the etchant is directed in jets, preferably from the bottom to the top, against the surface of the screen material so that the screen material which does not react to the etchant acts as an etching mask protecting the supporting material i.e. the copper, in the area of the screen webs against attacks by the etchant. However, since slight etching of the screen slot sides cannot be avoided completely, the desired conical enlargement of the screen slots is obtained in a simple manner.

FIG. 1 is a sectional view of a screen 1 manufactured in this way. A layer of screen material 2 is followed by a layer of supporting material 3. Screen slots 4, which open out conically from the working side 5 toward the rear side, extend through both layers. When the etching process is to be speeded up, which results in manufacturing advantages particularly where thick screens are being made etching has to be done on both surfaces of the screen. For this purpose an etching mask is necessary on the rear of the screen. This mask may be provided in a simple manner by coating the rear surface i.e. the copper surface of the intermediate product, with an insulating material. For this purpose, a resist as used in screen printing or photosensitive resist is used. For this purpose, a screen pattern, which corresponds substantially to the screen pattern on the matrix, is applied to the rear side of the screen. The pattern of the resist differs from that of the matrix only by the larger slot width corresponding to the conicity of the slots. When applying these screen patterns care must be taken that the screen pattern of the insulating material exactly conicides with the screen pattern of the screen material. When the insulating material layer has been applied, etching is carried out from both surfaces of the intermediate product with the mentioned etchant, until the screen slots are completely open. The insulating material acts as an etching mask during etching thereby preventing that the screen slot sides are being etched to too great an extent. After etching, the insulating material is removed with a solvent.

The screen 1 thus manufactured corresponds substantially to the screen already described and shown in FIG. 1. Differences are possible only in that, subject to the shape of the screen pattern made of insulating material, i.e. of the etching mask, the screen slot sides may have a steeper flank as is shown in FIG. 1 by the dashed lines (6). A further embodiment of the process according to the invention, an insulating material, for example, a photosensitive resist or a screen printing resist is also applied, preferably by screen printing, after the electrodeposition of the copper supporting material. However, in deviation from the process already described, a negative screen pattern is applied so that the insulating material covers the portions of the openings of the screen slots of the copper surface, whereas the portions of the copper surface corresponding to the webs between the screen slots remain metallically bright. When making the negative screen pattern, the conical enlargement of the screen slots must be taken into account. Moreover, attention must be paid to the exact registering with the screen pattern of the matrix. Contrary to the process modification described above, a thick layer of insulating material is applied which is 0.06 mm thick in the described embodiment. Then pure nickel is electrodeposited as a covering material. During this process, the insulating material prevents lateral growth into the slots.

Electrodeposition of the covering material is terminated as soon as the screen material layer, the supporting material layer, and the covering material layer together give the desired screen thickness and before the covering material is as thick as the insulating material layer. Non-compliance with the last condition results in a gradual lateral filling-up of the screen slots with covering material.

After the deposition of the covering material, the insulating material is removed with a suitable solvent. Subsequently, etching is carried out from both surfaces of the intermediate product. As in the other embodiments, a 30% sodium chloride solution is used as an etchant. Just like the screen material, the pure nickel used as a covering material does not react to the etchant, i.e. it forms an etching mask on the rear side of the intermediate product.

A sectional view of the screen 1 manufactured in this way is shown in FIG. 2. The rear of this screen 1 shows a layer of covering material 7.

Instead of pure nickel, another covering material may be used which is resistant to the etchant. The particular advantage of this process resides in that the rear of the screen may have a greater hardness.

The embodiments described have an indicative character only, because within the scope of the invention numerous other dimensions and, in particular, material combinations are possible. The process according to the invention is not only suited for the manufacture of working screens for sugar centrifugals but may also be applied to advantage for the manufacture of other fine screens subject to high stresses.

Before use, the screens manufactured according to the described embodiments are subjected to a surface improving treatment. For this purpose, the customary hard chromium plating process may be applied.

I claim:

1. A process for electroforming sugar centrifugal screens having screen slots and a given thickness, comprising preparing an electrically conducting matrix defining a screen pattern, depositing substantially non-etchable screen material by a first electrodeposition on said matrix, terminating said first electrodeposition of the screen material before said given screen thickness is reached and as soon as said screen slots in the substantially non-etchable screen material have reached a given dimension due to lateral growth of the deposited screen material, then depositing an etchable metallic support material by a second electrodeposition on one side of the non-etchable screen material until a thickness corresponding approximately to said given screen thickness is reached whereby the screen slots in said screen material are gradually filling up during said second electrodeposition from said one side toward the opposite side of the screen material removing the partially finished screen from the matrix, directing an etchant against the surface of the screen material opposite said one side the removed, partially finished screen whereby the screen material itself forms a resist since said liquid etchant is aggressive on the supporting material but does not attack the screen material, and continuing the etchant treatment until the screen slots previously filled up with supporting material are cleared and holes are formed having substantially conical or slanted side walls through the supporting material on the rear side of the screen, whereby the slots in the screen material are defined by a sharp edge of the screen material only on one side of the finished sugar centrifugal screen.

2. The process of claim 1, wherein said etchant is directed in jets from upwardly against the surface of the screen material.

3. The process of claim 1, further comprising coating, prior to said etchant treatment, the surface of the supporting material with a non-metallic insulating material in a resist pattern corresponding to the screen pattern, said resist pattern registering with the screen pattern on the front face of the screen, and then performing said etchant treatment by applying an etchant to both sides of the partially finished screen.

4. The process of claim 3, wherein said resist pattern of insulating material applied to the surface of the supporting material is adapted to the greater slot width on the rear of the screen at the surface of the supporting material.

5. The process of claim 1, wherein said resist pattern of insulating material is applied by a screen printing process.

6. A process for electroforming sugar centrifugal screens having screen slots and a given thickness, comprising preparing an electrically conducting matrix defining a screen pattern substantially depositing non-etchable screen material by a first electrodeposition on said matrix, terminating said first electrodeposition of the substantially non-etchable screen material before said given screen thickness is reached and as soon as said screen slots have reached a given dimension due to lateral growth of the deposited substantially non-etchable screen material, then depositing an etchable metallic support material by a second electrodeposition on the substantially non-etchable screen material, terminating said second electrodeposition before the given screen thickness is reached, then applying a resist pattern to the surface of said support material opposite said substantially non-etchable screen material said resist pattern forming a negative screen pattern of an electrically non-conductive insulating material, said negative screen pattern registering with the screen pattern and allowing for a larger screen slot width on the rear side of the screen than on the working side formed by said substantially non-etchable screen material, said negative screen pattern being applied to a thickness which together with the thickness of the entire material already electrodeposited equals at least to the given screen thickness, then applying by a third electrodeposition a covering material, which is also not attacked by an etchant, on those support material surfaces which have remained metallically bright, said third electrodeposition taking place until the given screen thickness is reached, whereby a lateral gradual filling up of the screen slots is avoided by the insulating material of said negative resist pattern, then removing the insulating material of the negative resist pattern, and applying an etchant to both sides of the partially finished screen until the screen slots are opened, whereby said screen material and said covering material (7) both act as a resist during the etching to form sugar centrifugal screen slots with sharp edges only on the side of the screen material and so that the slots have conical or slanted side walls from said screen material toward said covering material.

7. The process of claim 1 or 6, wherein after the etching, the screen is electroplated with a material providing an improved surface.

8. The process of claim 1 or 6, wherein nickel is deposited as a screen material, wherein copper is deposited as supporting material, and wherein the etching is carried out with a 30% sodium chloride solution.

9. The process of claim 6, wherein nickel is deposited also as said covering material, and wherein the material of said resist pattern is a photosensitive resist lacquer, a screen printing resist lacquer, or an epoxy resin.

* * * * *